US010975876B2

(12) United States Patent
Lin

(10) Patent No.: US 10,975,876 B2
(45) Date of Patent: Apr. 13, 2021

(54) COOLING DEVICE

(71) Applicant: COOLER MASTER CO., LTD., New Taipei (TW)

(72) Inventor: Fu-Lung Lin, New Taipei (TW)

(73) Assignee: COOLER MASTER CO., LTD., New Taipei (TW)

( * ) Notice: Subject to any disclaimer, the term of this patent is extended or adjusted under 35 U.S.C. 154(b) by 95 days.

(21) Appl. No.: 16/389,618

(22) Filed: Apr. 19, 2019

(65) Prior Publication Data

US 2020/0332804 A1 Oct. 22, 2020

(51) Int. Cl.

| | |
|---|---|
| ***F04D 29/00*** | (2006.01) |
| ***F04D 25/06*** | (2006.01) |
| *F04D 19/00* | (2006.01) |

(52) U.S. Cl.

CPC ..... *F04D 29/005* (2013.01); *F04D 25/0613* (2013.01); *F04D 19/002* (2013.01)

(58) Field of Classification Search

CPC .. F04D 29/005; F04D 25/0613; F04D 25/064; F21V 33/0096; F24F 3/056

See application file for complete search history.

(56) References Cited

U.S. PATENT DOCUMENTS

| | | | |
|---|---|---|---|
| 4,500,821 | A | 2/1985 | Bitting et al. |
| 5,052,472 | A | 10/1991 | Takahashi et al. |
| 5,738,496 | A | 4/1998 | Mehta |
| 6,054,676 | A | 4/2000 | Wall et al. |
| 6,120,262 | A | 9/2000 | McDonough et al. |
| 6,167,952 | B1 | 1/2001 | Downing |
| 6,213,617 | B1 | 4/2001 | Barker |
| 6,966,359 | B1 | 11/2005 | Liu |
| 7,007,506 | B2 | 3/2006 | Kubo et al. |
| 7,055,581 | B1 | 6/2006 | Roy |
| 7,183,939 | B1 | 2/2007 | Lo et al. |

(Continued)

FOREIGN PATENT DOCUMENTS

| | | | |
|---|---|---|---|
| CN | 201165989 | Y | 12/2008 |
| CN | 202914337 | A | 5/2013 |

(Continued)

OTHER PUBLICATIONS

Non-Final Office Action issued in U.S. Appl. No. 15/433,073, dated Jun. 22, 2018.

(Continued)

*Primary Examiner* — Juan G Flores

(74) *Attorney, Agent, or Firm* — McDermott Will & Emery LLP

(57) ABSTRACT

A cooling device includes a frame including a base portion and a barrel portion connected to the base portion, a fan assembly including a hub and a plurality of fan blades connected to the hub, the fan assembly rotatably coupled to the frame via at least one bearing positioned between the barrel part and the hub, a driving assembly disposed on the frame, and a decorative plate having a marking and a column coupled thereto and extending therefrom. The decorative plate is coupled to the base portion using the column and is stationary with respect to the fan assembly. The cooling device further includes a light assembly disposed on the driving assembly and emitting light that illuminates the marking.

18 Claims, 8 Drawing Sheets

(56) References Cited

U.S. PATENT DOCUMENTS

| | | | | |
|---|---|---|---|---|
| 7,240,722 | B2 | 7/2007 | Lai et al. | |
| 7,249,625 | B2 | 7/2007 | Duan | |
| 7,325,591 | B2 | 2/2008 | Duan et al. | |
| 8,051,898 | B2 | 11/2011 | Chiang | |
| 8,240,362 | B2 | 8/2012 | Eriksen | |
| 8,245,764 | B2 | 8/2012 | Eriksen | |
| 8,261,813 | B2 | 9/2012 | Oikawa | |
| 8,746,330 | B2 | 6/2014 | Lyon | |
| 9,345,169 | B1 | 5/2016 | Campbell et al. | |
| 9,441,640 | B2 | 9/2016 | Park et al. | |
| 9,795,058 | B2 | 10/2017 | Tsai | |
| 10,001,127 | B2 * | 6/2018 | Bonham | F04D 27/004 |
| 10,429,059 | B1 * | 10/2019 | Chen | H05K 7/20172 |
| 2003/0049124 | A1 | 3/2003 | Liu | |
| 2004/0130874 | A1 | 7/2004 | Maveety et al. | |
| 2005/0241806 | A1 | 11/2005 | Liu | |
| 2006/0133920 | A1 | 6/2006 | Chen | |
| 2006/0185378 | A1 | 8/2006 | Duan et al. | |
| 2006/0225867 | A1 | 10/2006 | Park et al. | |
| 2007/0248476 | A1 * | 10/2007 | Lewis | F04D 29/005 417/423.1 |
| 2008/0029260 | A1 | 2/2008 | Hu et al. | |
| 2009/0101316 | A1 | 4/2009 | Han et al. | |
| 2009/0122572 | A1 | 5/2009 | Page et al. | |
| 2009/0159244 | A1 | 6/2009 | Mounioloux | |
| 2009/0284921 | A1 | 11/2009 | Colgan et al. | |
| 2012/0152498 | A1 | 6/2012 | Lyon | |
| 2012/0175094 | A1 | 7/2012 | Rice | |
| 2013/0008628 | A1 | 1/2013 | Tiengtum et al. | |
| 2013/0051108 | A1 | 2/2013 | Nagao et al. | |
| 2015/0021756 | A1 | 1/2015 | Adachi | |
| 2016/0309618 | A1 | 10/2016 | Tsai et al. | |
| 2016/0338223 | A1 | 11/2016 | Tsai et al. | |
| 2016/0363967 | A1 | 12/2016 | Tsai | |
| 2017/0045300 | A1 | 2/2017 | Boday et al. | |
| 2017/0045306 | A1 | 2/2017 | Tsai | |
| 2017/0045307 | A1 | 2/2017 | Tsai | |
| 2017/0118870 | A1 | 4/2017 | Yin et al. | |
| 2017/0192471 | A1 | 7/2017 | Tsai et al. | |
| 2017/0235350 | A1 | 8/2017 | Tsai | |
| 2018/0045204 | A1 * | 2/2018 | Van Grootheest | F04D 25/088 |
| 2018/0139865 | A1 | 5/2018 | Draht et al. | |
| 2018/0163960 | A1 | 6/2018 | Lin | |
| 2018/0213677 | A1 | 7/2018 | Wu et al. | |
| 2018/0259267 | A1 | 9/2018 | Tsai et al. | |
| 2018/0332734 | A1 | 11/2018 | Bandorawalla et al. | |
| 2018/0340744 | A1 | 11/2018 | Tsai et al. | |

FOREIGN PATENT DOCUMENTS

| | | | |
|---|---|---|---|
| CN | 103133372 | A | 6/2013 |
| DE | 102011121064 | A1 | 6/2013 |
| JP | S61-018159 | A | 1/1986 |
| KR | 10-0529825 | B1 | 11/2005 |
| TW | M278938 | U | 10/2005 |
| TW | M311234 | U | 5/2007 |
| TW | M522274 | U | 5/2016 |

OTHER PUBLICATIONS

Final Office Action issued in U.S. Appl. No. 14/988,753, dated Jan. 11, 2019.
Non-Final Office Action issued in U.S. Appl. No 14/988,753, dated Aug. 8, 2018.
Final Office Action issued in U.S. Appl. No. 14/988,753, dated Jan. 16, 2018.
Non-Final Office Action issued in U.S. Appl. No. 14/988,753, dated Jul. 31, 2017.
Non-Final Office Action issued in U.S. Appl. No. 15/395,954, dated Feb. 15, 2019.
Final Office Action issued in U.S. Appl. No. 15/433,073, dated Nov. 13, 2018.
Non-Final Office Action issued in U.S. Appl. No. 15/394,410, dated Sep. 21, 2018.
Final Office Action issued in U.S. Appl. No. 15/394,410, dated Jan. 11, 2019.
Notice of Allowance issued in U.S. Appl. No. 15/394,410, dated Apr. 10, 2019.
Chinese Patent Application No. 201611132425.3 filed Dec. 9, 2016 with English translation.
Chinese Patent Application CN 201511023351.5 filed Dec. 30, 2015 with English translation.

* cited by examiner

COOLING DEVICE

BACKGROUND

Field

Example embodiments disclosed herein are directed to a cooling device, more particularly, to a fan having a decorative face plate that is stationary with respect to the fan blades.

Description of Related Art

With the increase of the processing speed and performance of electronic devices, such as central processing units (CPU), the amount of heat generated during operation of the electronic devices increases. The heat generation increases the temperature of the electronic device and, if the heat cannot be dissipated effectively, the reliability and performance of the electronic device is reduced. To prevent overheating of an electronic device, cooling apparatuses such as fans are used to efficiently dissipate the heat generated by the electronic device and, thereby ensure the standard operation of the electronic device.

In the case of fans or other rotary cooling apparatuses, identifying indicia such as a brand logo, a design, or other markings, are printed on the fan blades for the user to recognize the brand or manufacturer of the fan. However, the identifying indicia rotate when the fan blades rotate, making them unrecognizable to the user.

SUMMARY

An embodiment of this disclosure provides a cooling device including a frame including a base portion and a barrel portion connected to the base portion, a fan assembly including a hub and a plurality of fan blades connected to the hub, the fan assembly rotatably coupled to the frame via at least one bearing positioned between the barrel part and the hub, a driving assembly disposed on the frame, a decorative plate having a marking and a first column coupled thereto and extending therefrom, wherein the decorative plate is coupled to the base portion using the first column and is stationary with respect to the fan assembly, and a light assembly disposed on the driving assembly and emitting light that illuminates the marking.

Another embodiment of this disclosure provides a cooling device including a frame including a base portion and a barrel portion connected to the base portion, a fan assembly including a hub and a plurality of fan blades connected to the hub, the fan assembly rotatably coupled to the frame via at least one bearing positioned between the barrel part and the hub, a driving assembly disposed on the frame, a decorative plate having a marking and a column coupled thereto and extending therefrom, wherein the decorative plate is coupled to the base portion using the column and is stationary with respect to the fan assembly, and a light assembly disposed in the frame and located below the column, light from the light assembly illuminating the marking through the column.

Still another embodiment of this disclosure provides a cooling device including a frame including a base portion and a barrel portion connected to the base portion, a column coupled to the base portion, a fan assembly including a hub and a plurality of fan blades connected to the hub, the fan assembly rotatably coupled to the frame via at least one bearing positioned between the barrel portion and the hub, a driving assembly disposed on the frame, and a decorative plate having a marking and a column coupled to the decorative plate, the decorative plate being stationary with respect to the fan assembly.

BRIEF DESCRIPTION OF THE DRAWINGS

The following figures are included to illustrate certain aspects of the embodiments, and should not be viewed as exclusive embodiments. The subject matter disclosed is capable of considerable modifications, alterations, combinations, and equivalents in form and function, as will occur to those skilled in the art and having the benefit of this disclosure.

DETAILED DESCRIPTION

Embodiments described herein are directed to a cooling apparatus having identifying indicia that is stationary with respect to the moving parts of the cooling apparatus. This permits a user to identify the manufacturer or brand of the cooling apparatus with ease. For instance, in the case of fans or other rotating cooling apparatuses, the identifying indicia is placed on a face plate that is stationary with respect to the rotating fan blades. It should be noted that, although example embodiments are discussed below with reference to a fan, example embodiments are not limited in this regard and are equally applicable to other types of rotating cooling devices without departing from the spirit and scope of the disclosure.

Figure 1:
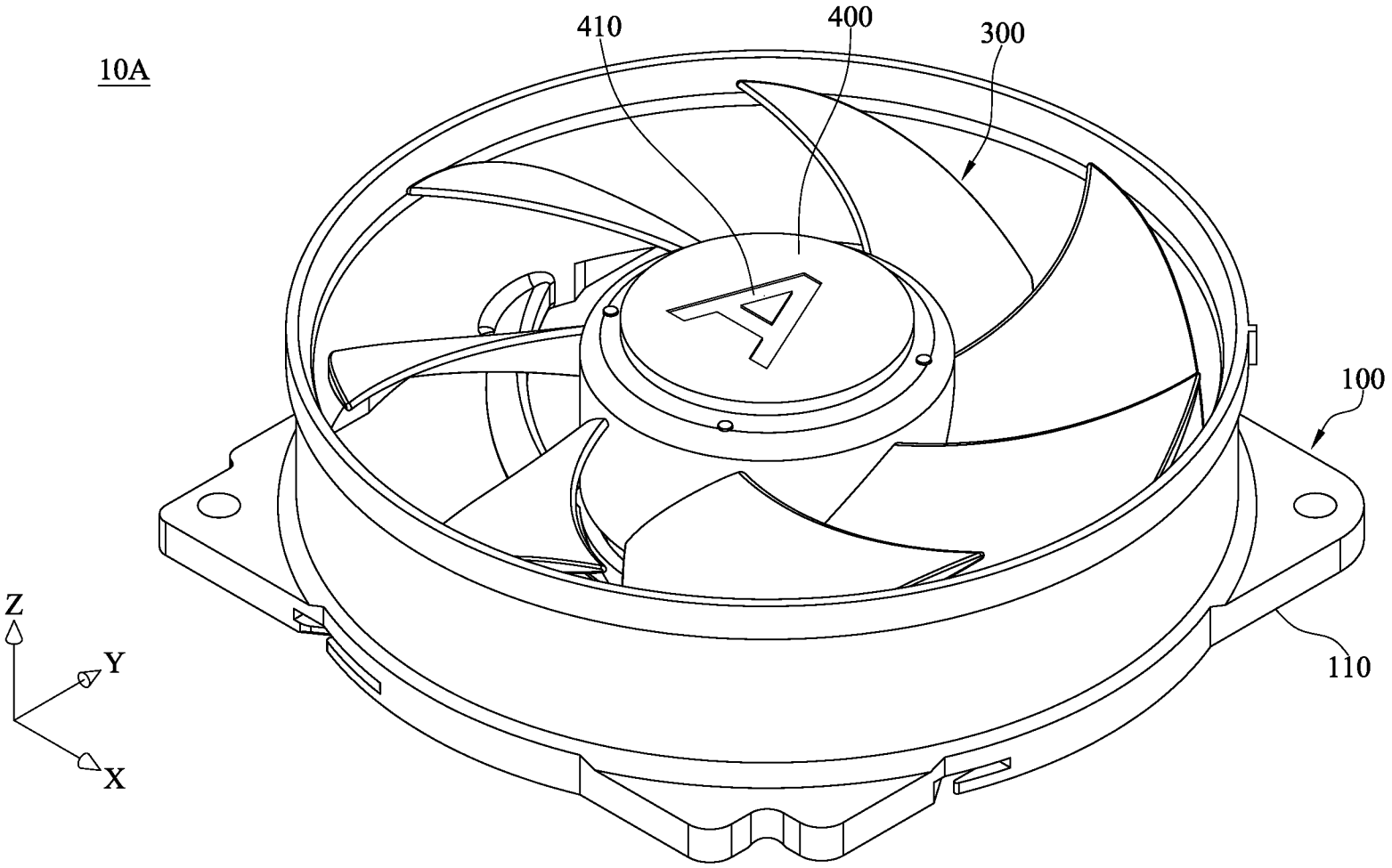
FIG. 1 is a perspective view of a cooling device according to an embodiment of the disclosure.
Figure 2A:
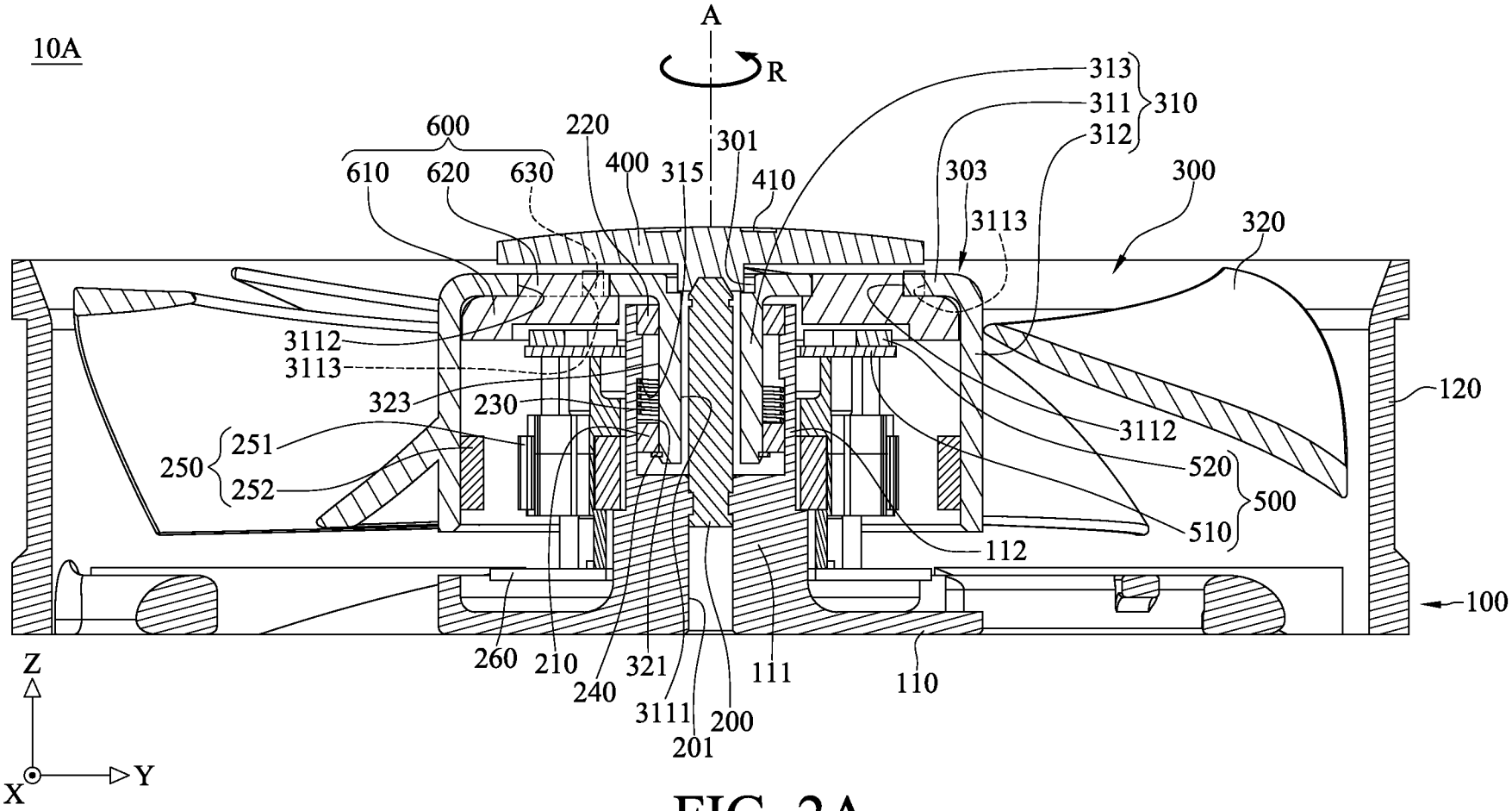
FIG. 2A is a cross-sectional view of the cooling device in FIG. 1.

FIG. 1 is a perspective view of a cooling device 10A embodying the principles disclosed herein. FIG. 2A is a cross-sectional view of the cooling device 10A in FIG. 1. In the exemplary embodiment, the cooling device 10A is a fan. However, the principles disclosed herein are also applicable to other types of cooling devices. Referring to FIGS. 1 and 2A, the fan 10A includes a fan frame 100, a column 200, a driving assembly 250, a driving circuit board 260, a fan assembly 300, a decorative plate 400, a light assembly 500, and a light guide plate 600.

The fan frame 100 includes a bottom plate 110 and an annular plate 120 connected to the bottom plate 110 and extending vertically therefrom. The bottom plate 110 includes a centrally located base portion 111 and a barrel portion 112. The barrel portion 112 is connected to the base portion 111 and extends vertically from the base portion 111. The annular plate 120 is disposed about the peripheral region of the fan 10A and surrounding the base portion 111 and the barrel portion 112.

In some embodiments, the column 200 is made of light-permeable material such as transparent or translucent material including acrylic, glass, plastic, etc. However, in other embodiments, the column 200 is made of an opaque material. The column 200 is fixed to the base portion 111 using a variety of known techniques. For example, the column 200 is secured to the base portion 111 using fasteners (nuts and bolts, screws, pins, rivets, anchors, seams, crimps, snap-fits, shrink-fits, etc.), magnets, high pressure pressing process, adhesives, a combination thereof, and the like. In an embodiment, and as illustrated, the column 200 is received in an opening 201 (e.g., a through hole (as illustrated) or a blind hole) in the base portion 111 and secured therein.

The fan assembly 300 is rotatably disposed on the barrel portion 112. The fan assembly 300 includes a hub 310 and a plurality of fan blades 320 extending radially from the hub 310. In an embodiment, the fan blades 320 are arched (or arcuate) structures that are curved or otherwise oriented opposite to the direction of rotation of fan blades 320. The hub 310 includes a cover plate 311, an outer annular part 312, and an inner annular part 313. The cover plate 311 is horizontally (XY direction) disposed over the base portion 111 and includes an opening 3111 (e.g., a through hole) centrally located in the cover plate 311, and a plurality of openings 3112 and a plurality of openings 3113 arranged about the opening 3111. The cover plate 311 includes a radially inner end 301 defined by the opening 3111 and a radially outer end 303. The outer annular part 312 is connected to and extends vertically downward (Z direction) from the radially outer end 303 and the inner annular part 313 is connected to and extends vertically downward (Z direction) from the radially inner end 301. The inner annular part 313 at least in part defines the opening 3111. The outer annular part 312 and the inner annular part 313 are radially spaced from each other. The column 200 is disposed in the opening 3111 and connected to the decorative plate 400. The plurality of openings 3112 are located radially inward from the plurality of openings 3113. Each opening 3112 is sized and shaped or otherwise configured to accommodate a protrusion 620 (discussed below) and each opening 3113 is sized and shaped or otherwise configured to accommodate a column 630 (discussed below).

The fan blades 320 are connected to and extend from the radially outer surface of the outer annular part 312. The fan assembly 300 is disposed on the fan frame 100 via two bearings 210 and 220, an elastic component 230, and an engagement component 240. The two bearings 210 and 220 are disposed about and in contact with a radially outer surface of the inner annular part 313 of the hub 310. The first bearing 210 is disposed at or adjacent an end of the inner annular part 313 proximate the base portion 111 while the second bearing 220 is disposed at or adjacent an axially opposite end of the inner annular part 313. In an embodiment, and as illustrated, the elastic component 230 is a spring that is disposed on the radially outer surface of the inner annular part 313 between the first bearing 210 and a shoulder 315 defined on the radially inner surface 321 of the barrel portion 112. The elastic component 230 contacts the first bearing 210. The engagement component 240 (e.g., a pin, a clip, a retaining ring, etc.) is disposed on the radially outer surface 323 of the inner annular part 313 and adjacent the base portion 111 to limit the movement of the first bearing 210. The elastic component 230 and the engagement component 240 limit vertical movement of the hub 310. The radially inner surface 321 of the barrel portion 112 surrounds and contacts against the two bearings 210 and 220. The bearings 210 and 220 thus enable the fan assembly 300 to rotate relative to the stationary fan frame 100.

The driving assembly 250 includes a stator 251 and a rotor 252. The stator 251 of the driving assembly 250 is disposed on the driving circuit board 260 on the bottom plate 110, and the rotor 252 of the driving assembly 250 is disposed on the hub 310 of the fan assembly 300. As such, the driving assembly 250 rotates the fan assembly 300 relative to the stationary fan frame 100.

The decorative plate 400 and the column 200 are both stationary with respect to the fan assembly 300. The decorative plate 400 can be coupled to the column 200 using a variety of techniques. For example, the decorative plate 400 is secured using fasteners (e.g., nuts and bolts, screws, pins, rivets, anchors, seams, crimps, snap-fits, shrink-fits, etc.), magnets, adhesives, male-female engagement features, a combination thereof, and the like. The decorative plate 400 includes a marking 410. The marking 410 permits light to pass therethrough.

The decorative plate 400 is made of light-permeable material such as transparent or translucent material including acrylic, glass, plastic, etc., and the marking 410 is formed on the decorative plate 400 by a spray painting process. Briefly, in a spray painting process, a mask including a pattern of the marking 410 is placed on the decorative plate 400. Paint is then applied by spraying and portions of the decorative plate 400 not covered by the pattern are sprayed with the paint and are thus made opaque. In an embodiment, and as illustrated, the marking 410 is the letter "A", but the embodiments are not limited in this regard. In other embodiments, the marking 410 may be a brand name, brand logo, or any desired marking.

Figure 2B:
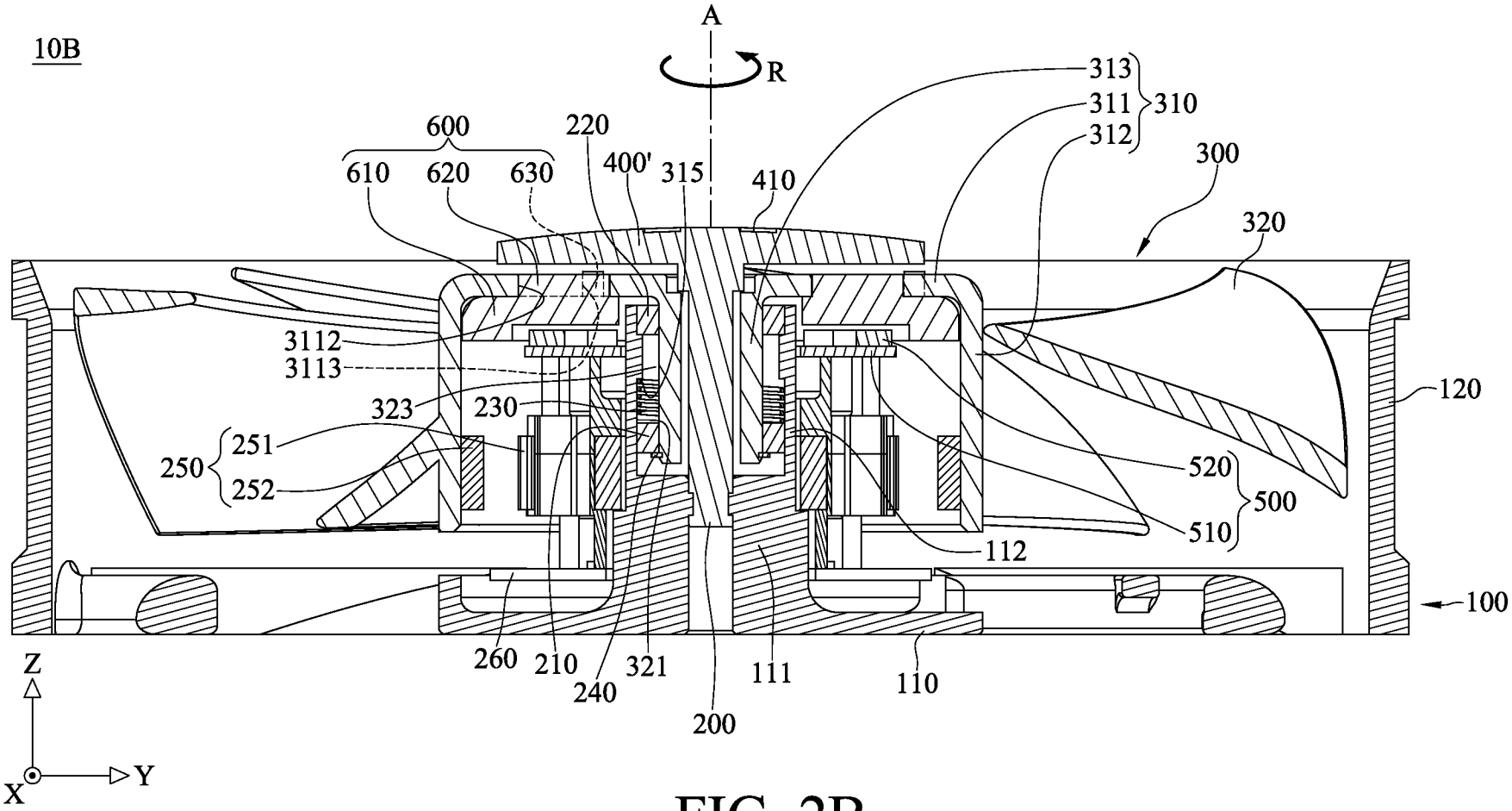
FIG. 2B is a cross-sectional view of a cooling device according to another embodiment.

In an embodiment, the decorative plate 400 and the column 200 are separate components connected to each other. However, embodiments are not limited in this regard. Referring briefly to FIG. 2B, illustrated is a cross-sectional view of another cooling device 10B embodying the principles disclosed herein. As illustrated, in the cooling device 10B, depicted as a fan, the decorative plate 400' and the column 200 are integrally formed with each other as a single unitary (undivided) structure made of light-permeable material.

Returning to FIG. 2A, the light assembly 500 incudes a circuit board 510 and a plurality of light sources 520. The circuit board 510 is arranged above the driving assembly 250 and is disposed on the fan frame 100 via the driving assembly 250. The light assembly 500 is positioned within the hub 310 and below the cover plate 311. The light sources 520 include, for example, light emitting diodes.

Figure 3:
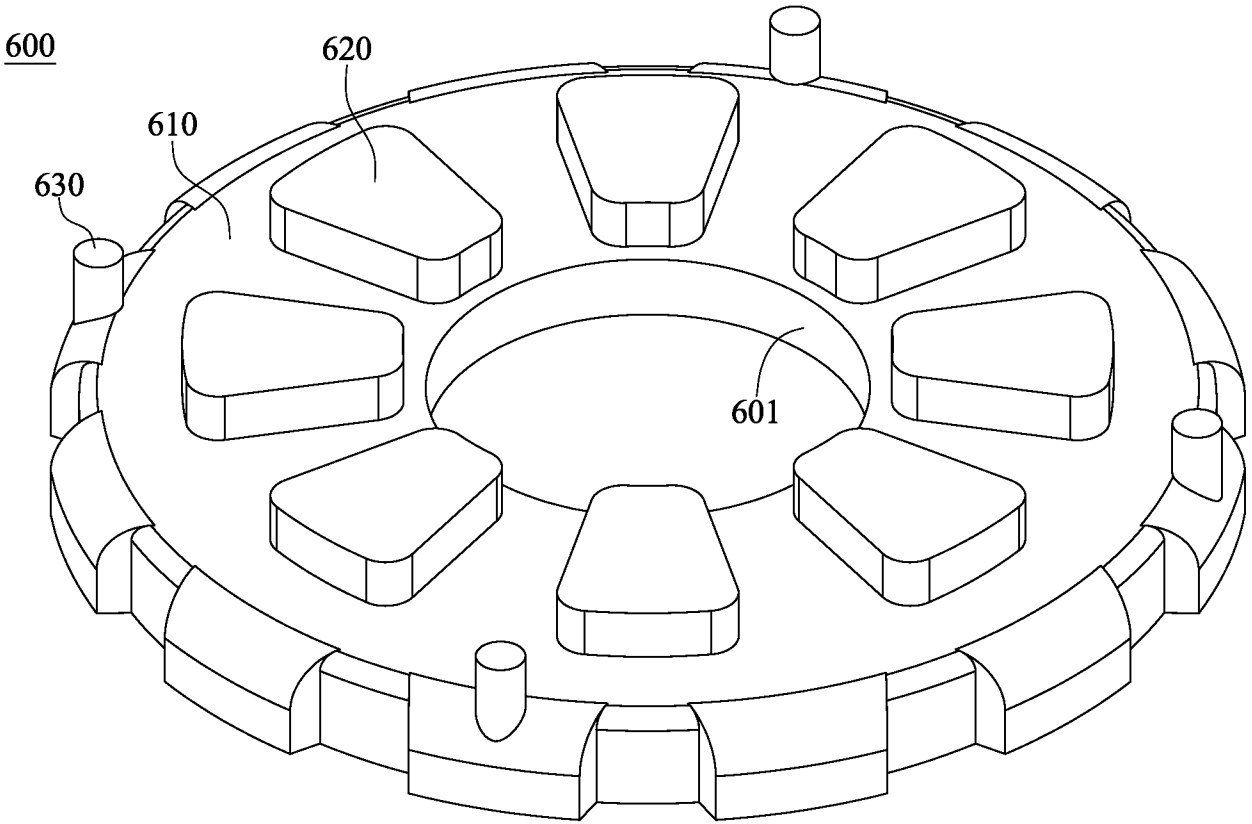
FIG. 3 is a perspective view of a light guide plate in FIGS. 2A and 2B, according to an embodiment.
Figure 4:
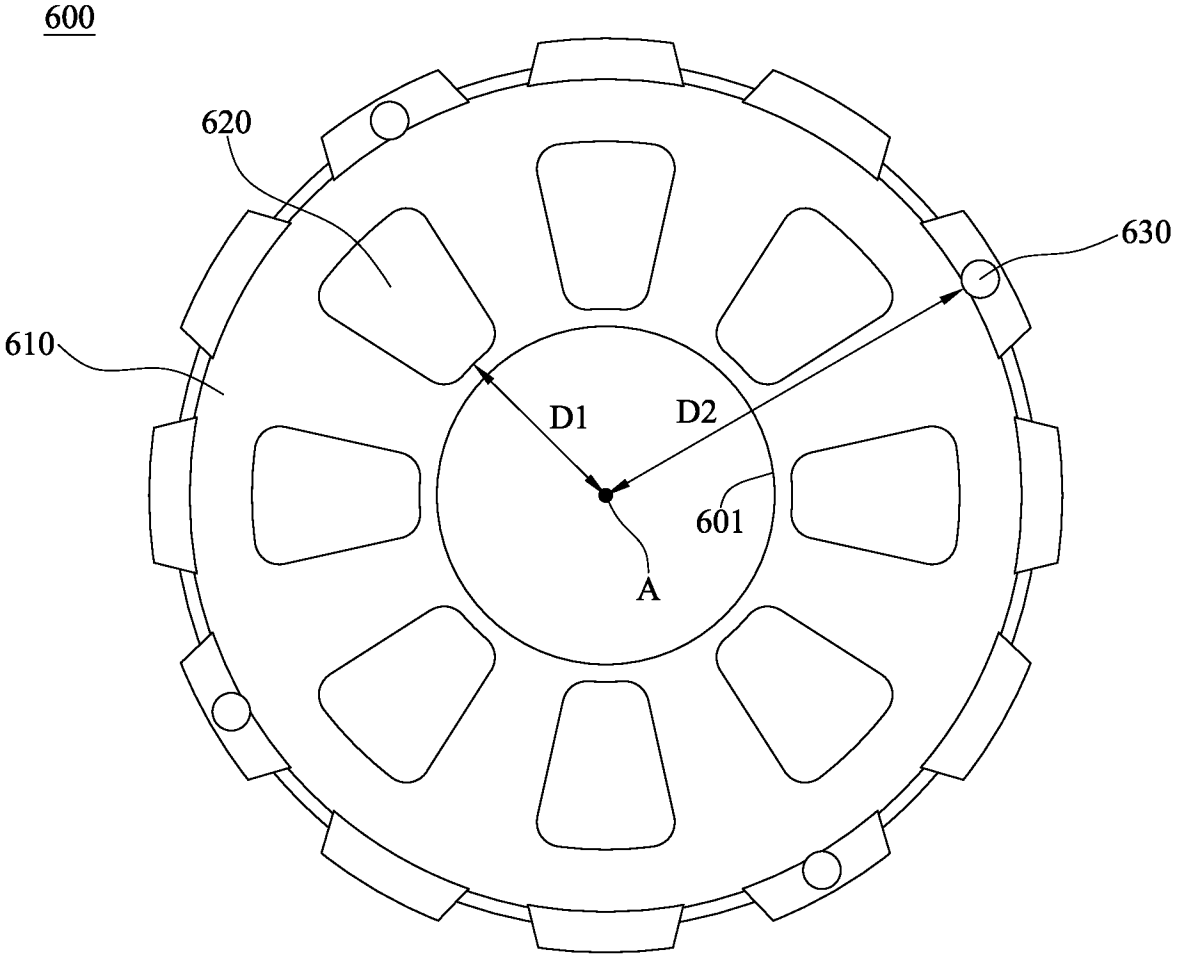
FIG. 4 is a plan view of the light guide plate in FIG. 3.

As shown in FIG. 2A, the light guide plate 600 is disposed within the hub 310 below the cover plate 311 and above the light assembly 500. FIG. 3 is a perspective view of the light guide plate 600, according to an embodiment. FIG. 4 is a plan view of the light guide plate 600. Referring to FIGS. 3 and 4, the light guide plate 600 includes a plate body 610, a plurality of protrusions 620 extending from the plate body 610, and a plurality of columns 630 extending from the plate body 610. The plurality of protrusions 620 are in a circular arrangement about a central opening 601 in the plate body 610. The plurality of columns 630 are arranged at or adjacent the radially outer end of the plate body 610. These protrusions 620 and columns 630 extend from the same side of the plate body 610. A distance D1 between the protrusion 620 and an axis of rotation A of the fan blades 320 is smaller than a distance D2 between the columns 630 and the axis of rotation A. The protrusions 620 and columns 630 are respectively located in the openings 3112 and the openings 3113. It should be noted that the number of protrusions 620 and columns 630 are not limited to those in FIGS. 3 and 4 and can be increased or decreased as per application and design requirements and without departing from the scope of the disclosure. The number of openings 3112 and the openings 3113 can similarly be increased or decreased.

Light emitted from the light sources 520 of the light assembly 500 passes through the protrusions 620 and the columns 630 of the light guide plate 600. The light from the protrusions 620 travels through the marking 410 on the decorative plate 400, and the light from the columns 630 lights up the periphery of the decorative plate 400.

When the driving assembly 250 rotates the fan assembly 300, the decorative plate 400 is stationary since the decorative plate 400 is fixed to the column 200, and light from the light sources 520 passes through the protrusions 620 and into the marking 410 of the decorative plate 400 and illuminates the marking 410. Thus, a user can more clearly recognize the marking 410. Part of light from the light sources 520 passes through the columns 630, such that the rotating columns form a light ring.

Figure 5:
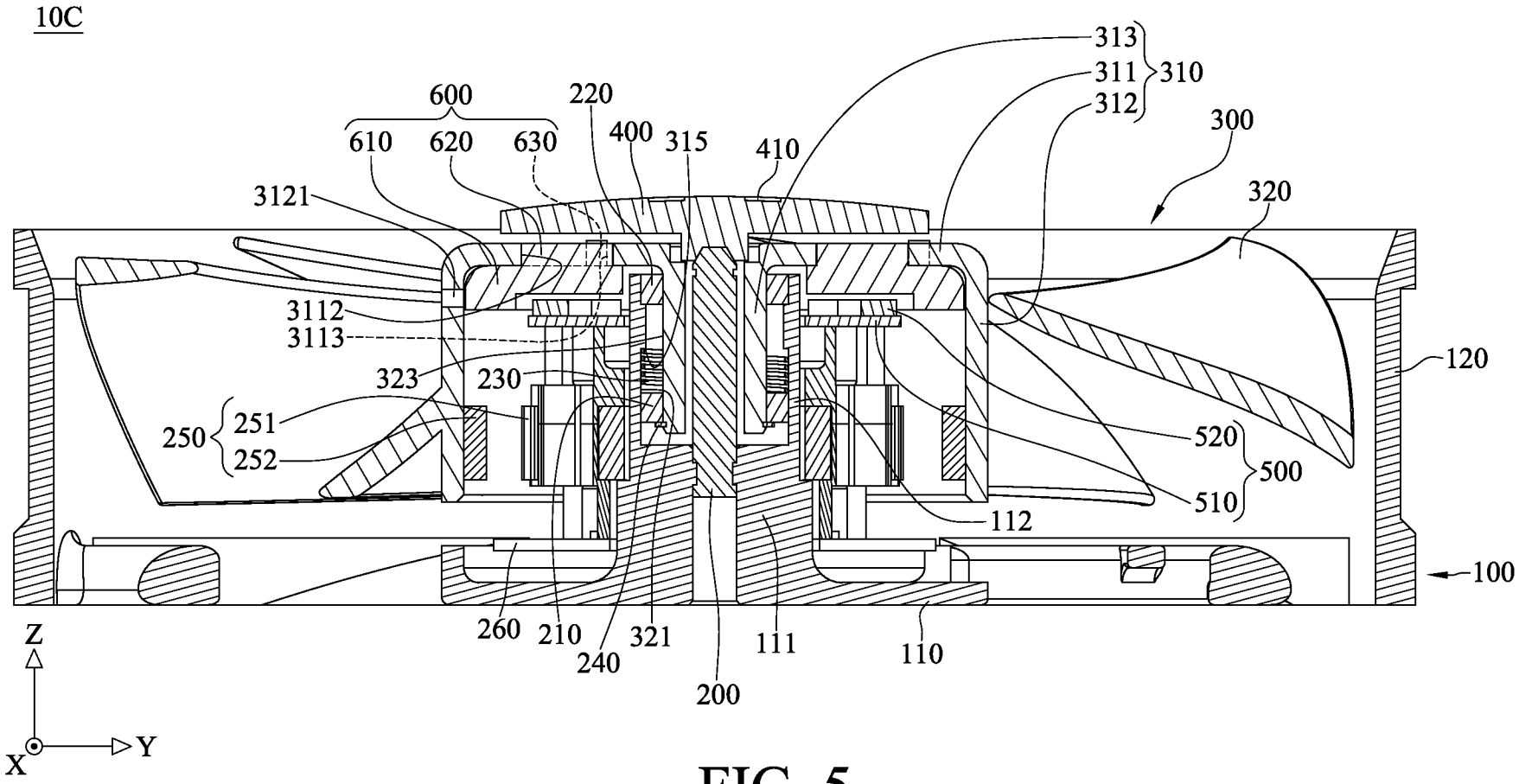
FIG. 5 is a cross-sectional view of a cooling device according to an embodiment of the disclosure.

FIG. 5 is a cross-sectional view of the fan 10C according to an embodiment of the disclosure. The fan 10C is similar in some respects to the fans 10A and 10B in FIGS. 1, 2A and 2B, and therefore may be best understood with reference thereto where like numerals designate like components not described again in detail. In the fan 10C, the fan assembly 300 is also made of transparent or translucent material such as acrylic, glass, plastic, or the like. The hub 310 is spray painted such that light cannot pass through the hub 310, and the fan blades 320 are not spray painted so that light can pass through the fan blades 320. Thus, light from the light assembly 500 is transmitted via the light guide plate 600 to the decorative plate 400, and thus the marking 410 is illuminated. The outer annular part 312 includes a side opening 3121. Light from the light assembly 500 illuminates some or all fan blades 320 via the side opening 3121. The size and shape of the side opening 3121 are not limited to any particular shapes and sizes, and can be of any shape and size that permits illumination of desired fan blades 320.

Figure 6:
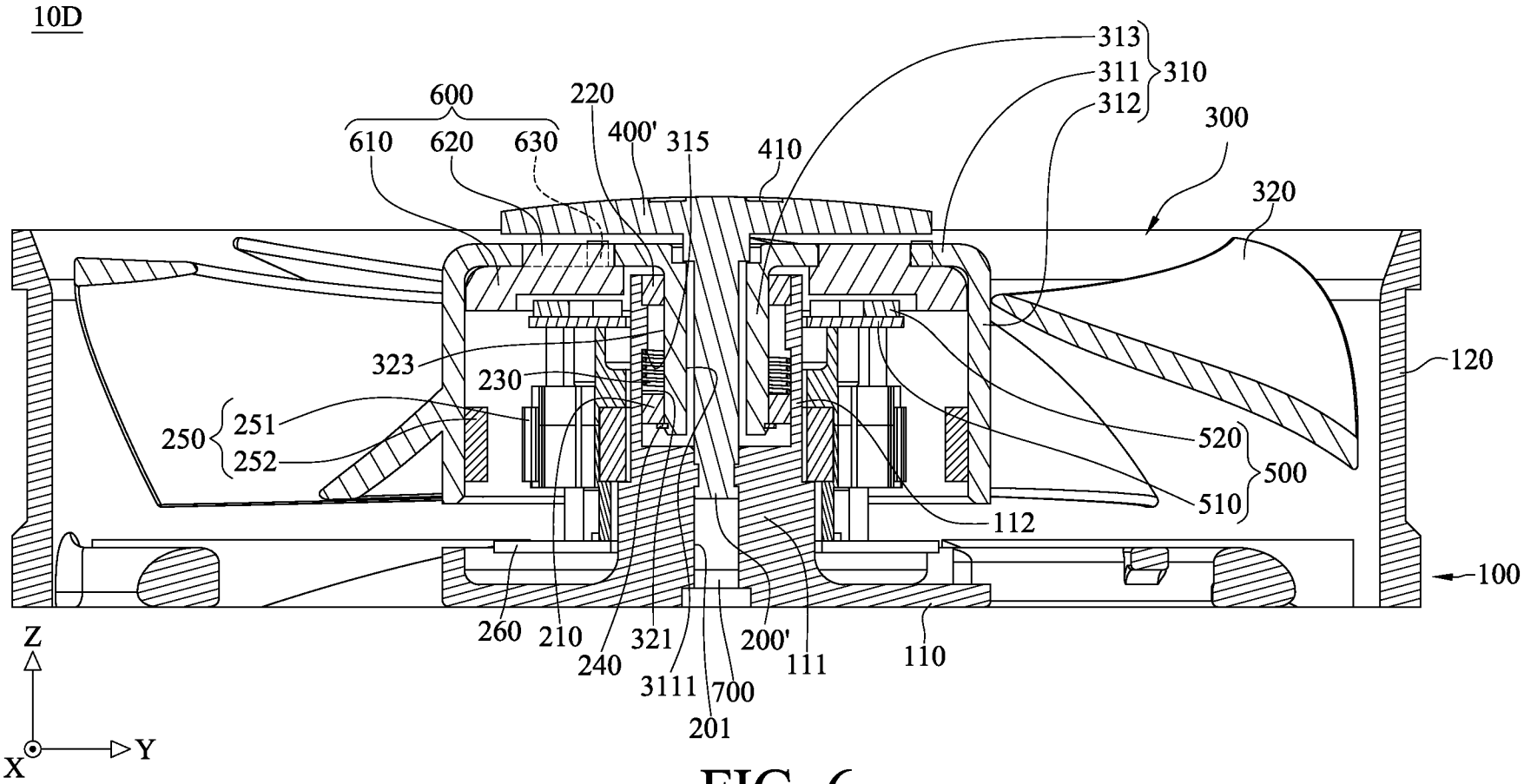
FIG. 6 is a cross-sectional view of another cooling device according to an embodiment of the disclosure.

FIG. 6 is a cross-sectional view of a fan 10D according to an embodiment of the disclosure. The fan 10D is similar in some respects to the fans 10A, 10B, and 10C in FIGS. 1, 2A, 2B, and 5 and therefore may be best understood with reference thereto where like numerals designate like components not described again in detail. As illustrated, the fan 10D includes a decorative plate 400' having a column 200' both made of a light permeable material. The column 200' extends from a central portion of the decorative plate 400' towards the bottom plate 110 through the opening 3111. The column 200' and decorative plate 400' are integrally formed together as a single unitary structure. The column 200' is secured to the base portion 111 using fasteners (e.g., nuts and bolts, screws, pins, rivets, anchors, seams, crimps, snap-fits, shrink-fits, etc.), magnets, high pressure pressing process, adhesives, a combination thereof, and the like. Also, the fan 10D includes a light emitting component 700 disposed on the bottom plate 110 of the fan frame 100 and under the column 200'. Therefore, light from the light emitting component 700 travels through the extending column 200' and lights the decorative plate 400'. In an embodiment, the light emitting component 700 is an LED or similar.

Figure 7:
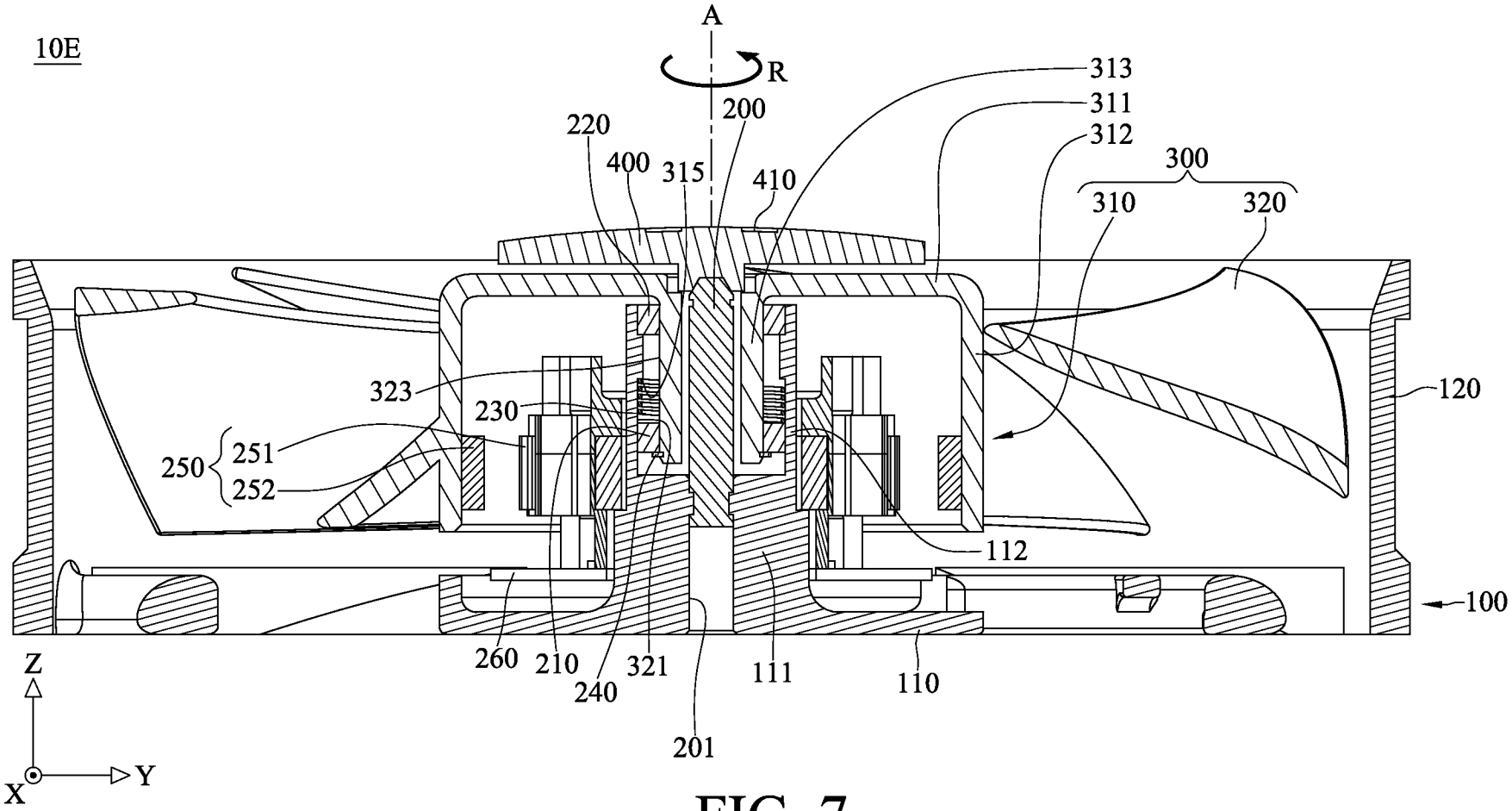
FIG. 7 is a cross-sectional view of yet another cooling device according to an embodiment of the disclosure.

FIG. 7 is a cross-sectional view of a fan 10E according to an embodiment of the disclosure. The fan 10E is similar in some respects to the fans 10A, 10B, 10C, 10D in FIGS. 1, 2A, 2B, 5, and 6 and therefore may be best understood with reference thereto where like numerals designate like components not described again in detail.

In the fan 10E, the light assembly 500, the light guide plate 600, and the light emitting component 700 from the fans 10A, 10B, 10C, and 10D in FIGS. 1, 2A, 2B, 5, and 6 are absent. The decorative plate 400 is secured to a stationary column 200 instead of the hub 310 of the fan assembly 300. As a result, the decorative plate 400 including the marking 410 does not move when the fan assembly 300 rotates, and thus permits a user to more clearly recognize the marking 410.

The foregoing outlines features of several embodiments or examples so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments or examples introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A cooling device, comprising:

a frame including a base portion and a barrel portion connected to the base portion;

a fan assembly including a hub and a plurality of fan blades connected to the hub, the fan assembly rotatably coupled to the frame via at least one bearing positioned between the barrel portion and the hub;

a driving assembly disposed on the frame;

a decorative plate having a marking and a first column coupled thereto and extending therefrom, wherein the decorative plate is coupled to the base portion using the first column and is stationary with respect to the fan assembly; and a light assembly disposed on the driving assembly and emitting light that illuminates the marking.

2. The cooling device according to claim 1, wherein the base portion includes an opening configured to receive the first column, wherein at least a portion of the first column is disposed in the opening.

3. The cooling device according to claim 1, further comprising:

a light guide plate arranged between the driving assembly and the hub, wherein the hub includes a cover plate and an outer annular part, the outer annular part is connected to and extends from a radially outer end of the cover plate, the cover plate includes a first opening and a second opening, the first column is positioned in the first opening, the light guide plate includes a plate body and at least one protrusion extending from the plate body, and the plate body contacts the hub, and the at least one protrusion is received in the second opening, light from the light assembly illuminating the marking via the at least one protrusion.

4. The cooling device according to claim 3, wherein the hub further includes an inner annular part connected to and extending from a radially inner end of the cover plate, and wherein the inner annular part defines the first opening.

5. The cooling device according to claim 3, wherein the cover plate further includes a third opening, and the light guide plate further includes at least one second column disposed on the plate body and received in the third opening, and a distance between the at least one second column and an axis of rotation of the plurality of fan blades is greater than a distance between the at least one protrusion and the axis of rotation.

6. The cooling device according to claim 3, wherein the outer annular part includes an opening, and light from the light assembly illuminates at least some of the plurality of fan blades via the opening.

7. The cooling device according to claim 1, wherein the decorative plate and the first column are integrally formed.

8. The cooling device according to claim 1, wherein the decorative plate is separate from the first column and is coupled to the first column.

9. The cooling device according to claim 1, wherein the decorative plate is coupled to the first column using magnets.

10. A cooling device, comprising:

a frame including a base portion and a barrel portion connected to the base portion;

a fan assembly including a hub and a plurality of fan blades connected to the hub, the fan assembly rotatably coupled to the frame via at least one bearing positioned between the barrel portion and the hub;

a driving assembly disposed on the frame;

a decorative plate having a marking and a column coupled thereto and extending therefrom, wherein the decorative plate is coupled to the base portion using the column and is stationary with respect to the fan assembly; and a light assembly disposed in the frame and located below the column, light from the light assembly illuminating the marking through the column.

11. The cooling device according to claim 10, wherein the base portion includes a first opening configured to receive the column, wherein at least a portion of the column is disposed in the first opening.

12. The cooling device according to claim 11, wherein the hub includes a cover plate, an outer annular part connected to and extending from a radially outer end of the cover plate, and an inner annular part connected to and extending from a radially inner end of the cover plate, wherein the inner annular part defines a second opening, and the column is positioned in the second opening.

13. A cooling device, comprising:

a frame including a base portion and a barrel portion connected to the base portion;

a column coupled to the base portion;

a fan assembly including a hub and a plurality of fan blades connected to the hub, the fan assembly rotatably coupled to the frame via at least one bearing positioned between the barrel portion and the hub;

a driving assembly disposed on the frame; and a decorative plate having a marking and coupled to the column, the decorative plate being stationary with respect to the fan assembly.

14. The cooling device according to claim 13, wherein the base portion includes a first opening configured to receive the column, wherein at least a portion of the column is disposed in the first opening.

15. The cooling device according to claim 14, wherein the hub includes a cover plate, an outer annular part connected to and extending from a radially outer end of the cover plate, and an inner annular part connected to and extending from a radially inner end of the cover plate, wherein the inner annular part defines a second opening, and the column is positioned in the second opening.

16. The cooling device according to claim 13, wherein the decorative plate and the column are integrally formed.

17. The cooling device according to claim 13, wherein the decorative plate is separate from the column and is coupled to the column.

18. The cooling device according to claim 13, wherein the decorative plate is coupled to the column using magnets.

* * * * *